US011300068B1

(12) United States Patent
Hill et al.

(10) Patent No.: US 11,300,068 B1
(45) Date of Patent: Apr. 12, 2022

(54) FUEL SYSTEM FOR RETARDED ARMATURE LIFTING SPEED AND FUEL SYSTEM OPERATING METHOD

(71) Applicant: Caterpillar Inc., Peoria, IL (US)

(72) Inventors: Adam Charles Hill, Pontiac, IL (US); Zhenyu Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/228,848

(22) Filed: Apr. 13, 2021

(51) Int. Cl.
*F02D 41/40* (2006.01)
*F02D 41/20* (2006.01)
*F02M 63/00* (2006.01)

(52) U.S. Cl.
CPC ..... *F02D 41/20* (2013.01); *F02D 41/40* (2013.01); *F02M 63/0021* (2013.01); *F02D 2041/2027* (2013.01); *F02D 2041/2037* (2013.01)

(58) Field of Classification Search
CPC .. F02D 41/20; F02D 41/40; F02D 2041/2037; F02D 2041/2027; F02M 63/0021
USPC ..... 123/490, 472, 478, 479, 480, 482, 488; 701/103–105; 251/129.01, 129.15
See application file for complete search history.

(56) References Cited

U.S. PATENT DOCUMENTS

| | | | |
|---|---|---|---|
| 8,316,826 | B2 | 11/2012 | Coldren et al. |
| 9,650,983 | B2 | 5/2017 | Gautier et al. |
| 10,072,596 | B2 | 9/2018 | Dames et al. |
| 10,704,487 | B2 | 7/2020 | Baur et al. |
| 2017/0330666 | A1 | 11/2017 | Dames et al. |

*Primary Examiner* — Hai H Huynh
(74) *Attorney, Agent, or Firm* — Brannon Sowers & Cracraft

(57) ABSTRACT

A fuel system for an internal combustion engine includes a fuel injector, and a fueling control unit electrically connected to a solenoid in the fuel injector. The fueling control unit energizes the solenoid with a lift current pulse to lift an armature, then energizes the solenoid with a separate capture current pulse to capture the armature at a lifted position. The solenoid is deenergized a dwell time while the armature is in flight toward the lifted position. Armature lifting speed is retarded based on the deenergizing of the solenoid so as to limit bouncing of a valve pin in the fuel injector against a stop. The techniques assist in linearizing a fuel delivery curve.

20 Claims, 5 Drawing Sheets

FUEL SYSTEM FOR RETARDED ARMATURE LIFTING SPEED AND FUEL SYSTEM OPERATING METHOD

TECHNICAL FIELD

The present disclosure relates generally to a fuel system for an internal combustion engine, and more particularly to energizing a solenoid with multiple current pulses separated by a dwell time so as to retard a control valve armature in a fuel injector.

BACKGROUND

Fuel systems in internal combustion engines, and notably compression-ignition engines, are typically complex apparatuses. Fuel injectors and other fuel system components are subjected to harsh service conditions including high fluid pressures and rapid pressure changes, and repeated impacts of valve assembly components over time. Fuel pressures can be in excess of 200 megapascals (MPa), and such injectors will be actuated millions or even billions of times over the course of a service life. Reliable and repeatable performance of fuel injector components, particularly with respect to fuel delivery quantity, can be critical to achieving power density, emissions mitigation, and efficiency goals.

Systems for monitoring, controlling, and electronically trimming fuel system components to various ends are well known throughout the industry. It has been observed that "bouncing" of certain fuel injector components, for instance, where a component such as a valve bounces against a valve seat or stop, can negatively impact performance, particularly with respect to valve timing, accuracy, or precision. Valve timings tend to be directly linked to a quantity of fuel delivered, thus improved precision, accuracy, and reliability in valve timing has received considerable engineering attention over the years. Fuel injector designs are routinely updated and sometimes modified altogether. Accordingly, strategies for valve timing accuracy and precision improvements that are successful for one fuel injector configuration may have limited applicability to other designs.

U.S. Pat. No. 8,316,826 to Coldren et al. is directed to reducing variations in close-coupled post injections in a fuel system context. According to Coldren et al., an electrically controlled fuel injector includes an armature movable between first and second armature positions inside an armature cavity containing fuel. The armature cavity is apparently reduced in size to a squish film drag gap that reduces armature travel speed but also reduces settling time of the armature after an injection event. The reduction to armature travel speed apparently reduces a magnitude of armature bounce thus improving controllability. The strategy set forth by Coldren et al. undoubtedly has applications, there is nevertheless always room for improvements and development of alternative strategies in the fuel systems field.

SUMMARY OF THE INVENTION

In one aspect, a fuel system for an engine includes a fuel injector including an outlet check with a closing hydraulic surface exposed to a fluid pressure of a control chamber formed in the fuel injector, a stop, and an injection control valve assembly including a solenoid, an armature, and a valve pin coupled to the armature. A fueling control unit is electrically connected to the solenoid and structured to energize the solenoid with a lift current pulse to lift the armature. The fueling control unit is further structured to energize the solenoid with a capture current pulse to capture the armature at a lifted position, to deenergize the solenoid a dwell time while the armature is in flight toward the lifted position, and retard the armature based on the deenergizing of the solenoid a dwell time to limit bouncing of the valve pin against the stop.

In another aspect, a method of operating a fuel system for an internal combustion engine includes energizing a solenoid with a lift current pulse to lift an armature coupled to an injection control valve in a fuel injector from a rest position. The method further includes opening the injection control valve based on the lifting of the armature to start an injection of fuel from the fuel injector using a directly controlled outlet check. The method still further includes energizing the solenoid with a capture current pulse occurring after the lift current pulse to capture the armature at the lifted position. The method still further includes returning the armature to the rest position, and closing the injection control valve based on the returning of the armature to the rest position to end an injection of fuel using the directly controlled outlet check.

In still another aspect, a fuel control system includes a fueling control unit having a data processor, and a computer readable memory. The computer readable memory stores fueling control instructions for actuating a fuel injector to inject fuel into a combustion cylinder in an engine. The data processor is structured by way of executing the fueling control instructions to energize a solenoid in the fuel injector with a lift current pulse to lift an armature coupled to a valve pin in an injection control valve assembly, and energize the solenoid with a capture current pulse to capture the armature at a lifted position. The fueling control unit is further structured to deenergize the solenoid for a dwell time while the armature is in flight toward the lifted position, and to retard a lifting speed of the armature based on the deenergizing of the solenoid for a dwell time so as to limit bouncing the valve pin against a stop in the fuel injector.

DETAILED DESCRIPTION

Figure 1:
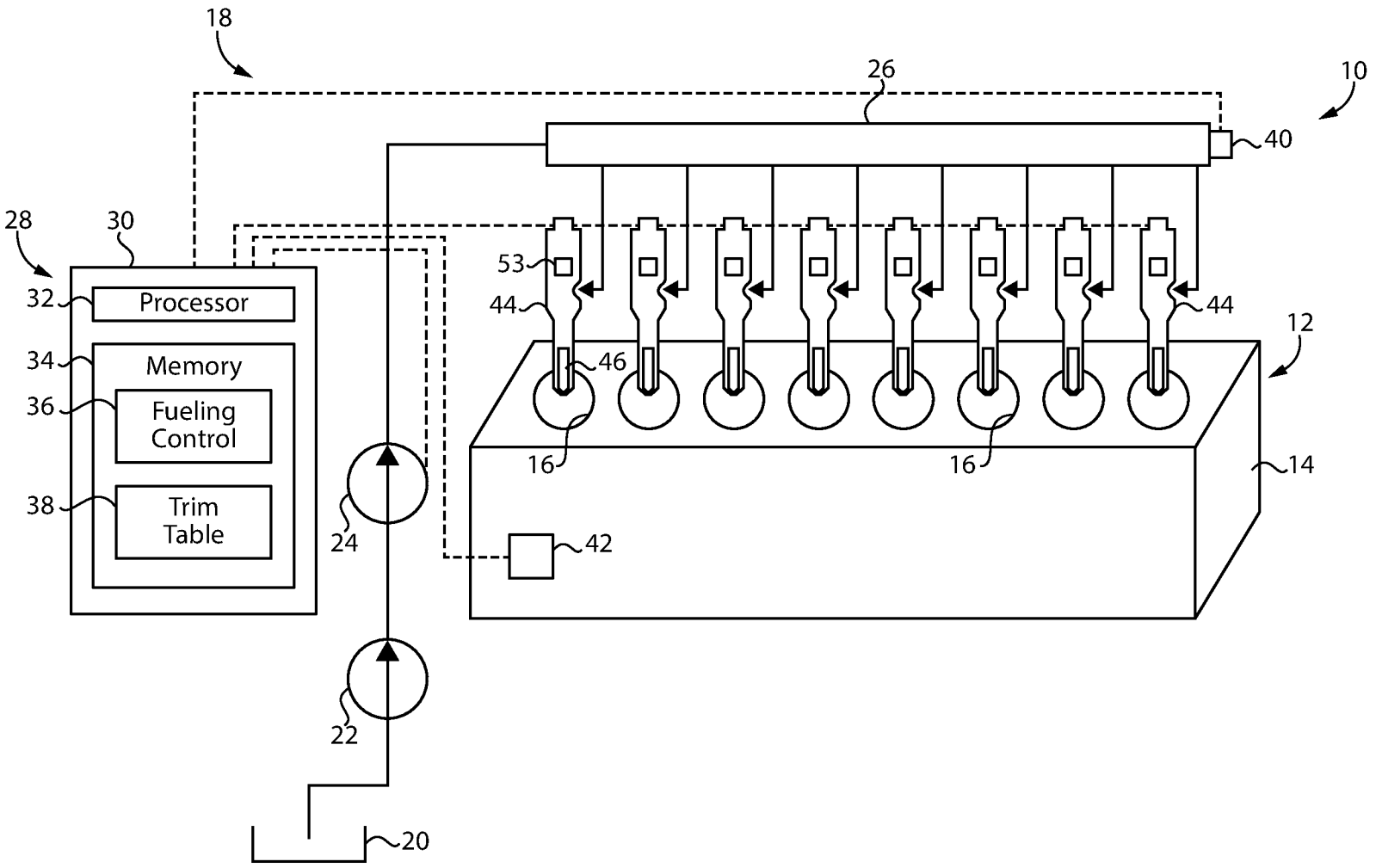
FIG. 1 is a diagrammatic view of an internal combustion engine system, according to one embodiment.

Referring to FIG. 1, there is shown an internal combustion engine system 10 according to one embodiment. Internal combustion engine system 10 includes an internal combustion engine 12 including an engine housing 14 having a plurality of combustion cylinders 16 formed therein. Combustion cylinders 16 can include any number of combustion cylinders in any suitable arrangement, such as an inline pattern, a V-pattern, or still another. Internal combustion engine system 10 can be employed for propelling a vehicle, powering a pump, a compressor or other industrial equipment, or for generating electrical power, to name a few examples. Each of combustion cylinders 16 will be equipped with a piston, with the pistons coupled to a crankshaft in a generally conventional manner. Internal combustion engine system 10 may also be equipped with an intake system, typically including one or more turbochargers, an exhaust system structured for emissions control, a valve train and various other components and systems not specifically illustrated that will be familiar to those skilled in the art. Internal combustion engine 12 may be compression-ignited and operate in a conventional four-stroke engine cycle, although the present disclosure is not limited in such regards.

Internal combustion engine system 10 further includes a fuel system 18. Fuel system 18 may include a fuel tank 20 storing a suitable compression-ignition fuel, such as a diesel distillate fuel. Fuel system 18 also includes a low pressure transfer pump 22, and a high pressure pump 24 structured to pressurize a liquid fuel and feed the same to a pressurized fuel reservoir or common rail 26. Common rail 26 maintains a supply of pressurized fuel for feeding to a plurality of fuel injectors 44 of fuel system 18. In other embodiments, multiple pressurized fuel reservoirs could be provided each structured to supply pressurized fuel to less than all of fuel injectors 44. In still other instances, so-called unit pumps could be coupled to or associated with each of fuel injectors 44. Fuel system 18 further includes a fuel control system 28 structured to operate fuel injectors 44 and fuel pumps 22 and 24. Fuel control system 28 includes a fueling control unit 30 having a data processor 32. Data processor 32 can be any suitable computerized control device having a central processing unit, or multiple such devices, such as a microprocessor or a microcontroller. Fueling control unit 30 further includes a computer readable memory 34 storing fueling control instructions 36 for actuating fuel injectors 44 to inject fuel into combustion cylinders 16 in internal combustion engine 12, according to principals and procedures further discussed herein. Computer readable memory 34 further stores a trim table 38 in the illustrated embodiment, whereby data processor 32 can electronically trim fuel injectors 44 during operation, again according to principals and procedures further discussed herein. Fuel control system 28 may further include a fuel pressure sensor 40 structured to monitor a pressure of fuel in common rail 26 enabling fueling control unit 30 to vary operation of high pressure pump 24 to maintain or adjust a desired injection pressure of fuel injected by way of fuel injectors 44. Fuel control system 28 may also include an engine state sensor 42, such as an engine speed sensor, providing data as to engine state used in controlling fuel pressure and/or operating fuel injectors 44, as further discussed herein.

Figure 2:
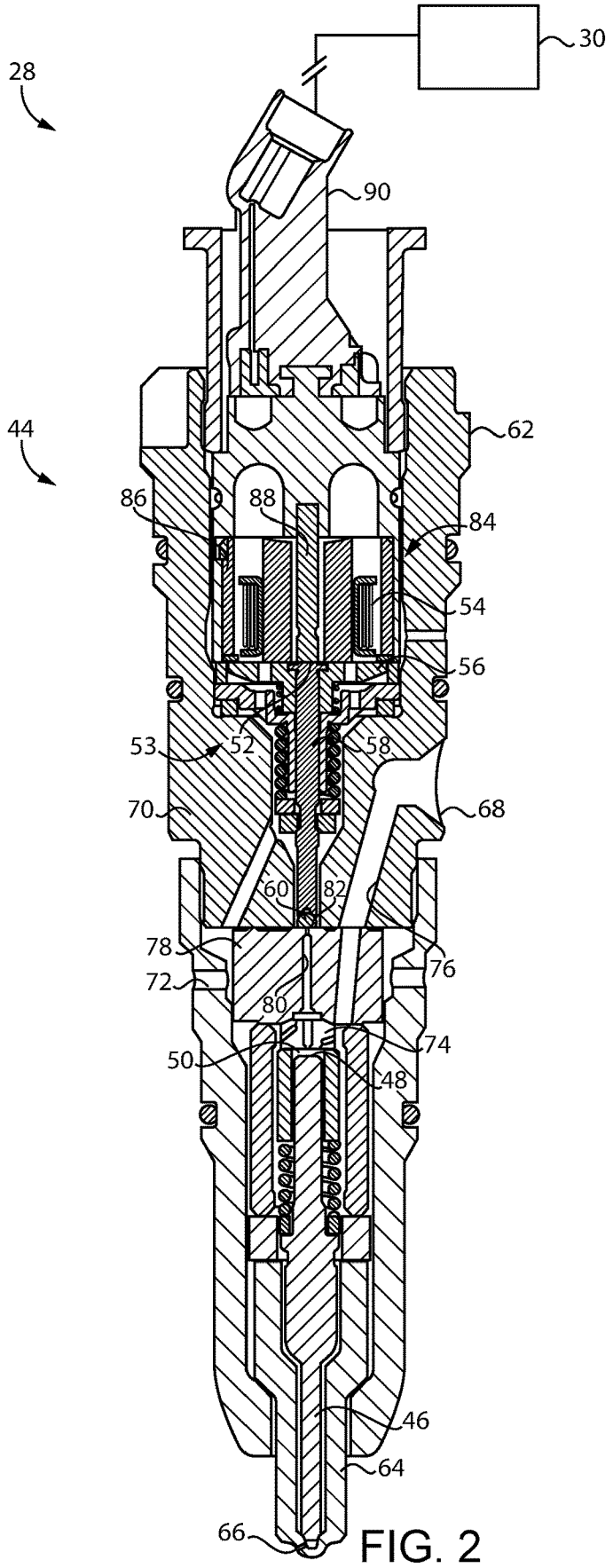
FIG. 2 is a sectioned side diagrammatic view of a fuel injector in a fuel system, according to one embodiment.

Referring also now to FIG. 2, each of fuel injectors 44, referred to hereinafter at times in the singular, includes an outlet check 46 having a closing hydraulic surface 48 exposed to a fluid pressure of a control chamber 50 formed in fuel injector 44. Fuel injector 44 also includes a stop 52, and an injection control valve assembly 53. Injection control valve assembly 53 includes a solenoid 54, electrically connected to fueling control unit 30, an armature 56, a valve pin 58 coupled to armature 56, and an injection control valve 60. Fuel injector 44 further includes an injector housing 62 having a nozzle tip piece 64 positionable for direct injection of fuel into one of combustion cylinders 16, and having a plurality of spray outlets 66 formed therein. Injector housing 62 further includes an injector body 70 having a high pressure fuel inlet 68 formed therein. High pressure fuel inlet 68 is structured to fluidly connect, such as by way of a so-called quill connector or the like, to common rail 26. Injector housing 62 further defines a low pressure space 72. Low pressure space 72 includes a low pressure outlet formed in injector housing 62, but can otherwise be understood to be any cavity, volume, or outlet in injector housing 62, within, between, or among components in fuel injector 44, that will have a low pressure relative to a pressure of fuel supplied to high pressure fuel inlet 68. A high pressure inlet passage 76 extends from high pressure fuel inlet 68 to outlets 66. Outlet check 46 is movable to open and close outlets 66. An orifice plate 74 is within injector housing 62 and has one or more orifices (not numbered) therein that fluidly connect inlet passage 76 to control chamber 50. Orifice plate 74 in part defines control chamber 50, and is structured such that increasing or decreasing a closing hydraulic pressure of fuel on outlet check 46 controls starting of fuel injection and ending of fuel injection in a generally conventional manner. A valve seat plate 78 is clamped between injector body 70 and orifice plate 74. Valve seat plate 78 forms a valve seat 82, and a drain passage 80 extends between valve seat 82 and control chamber 50, by way of an orifice in orifice plate 74. Orifice plate 74 and valve seat plate 78 could be integrated into a single component in some embodiments. Injection control valve 60 is movable between a closed position blocking valve seat 82, and an open position at which drain passage 80 is fluidly connected to low pressure space 72.

Figure 3:
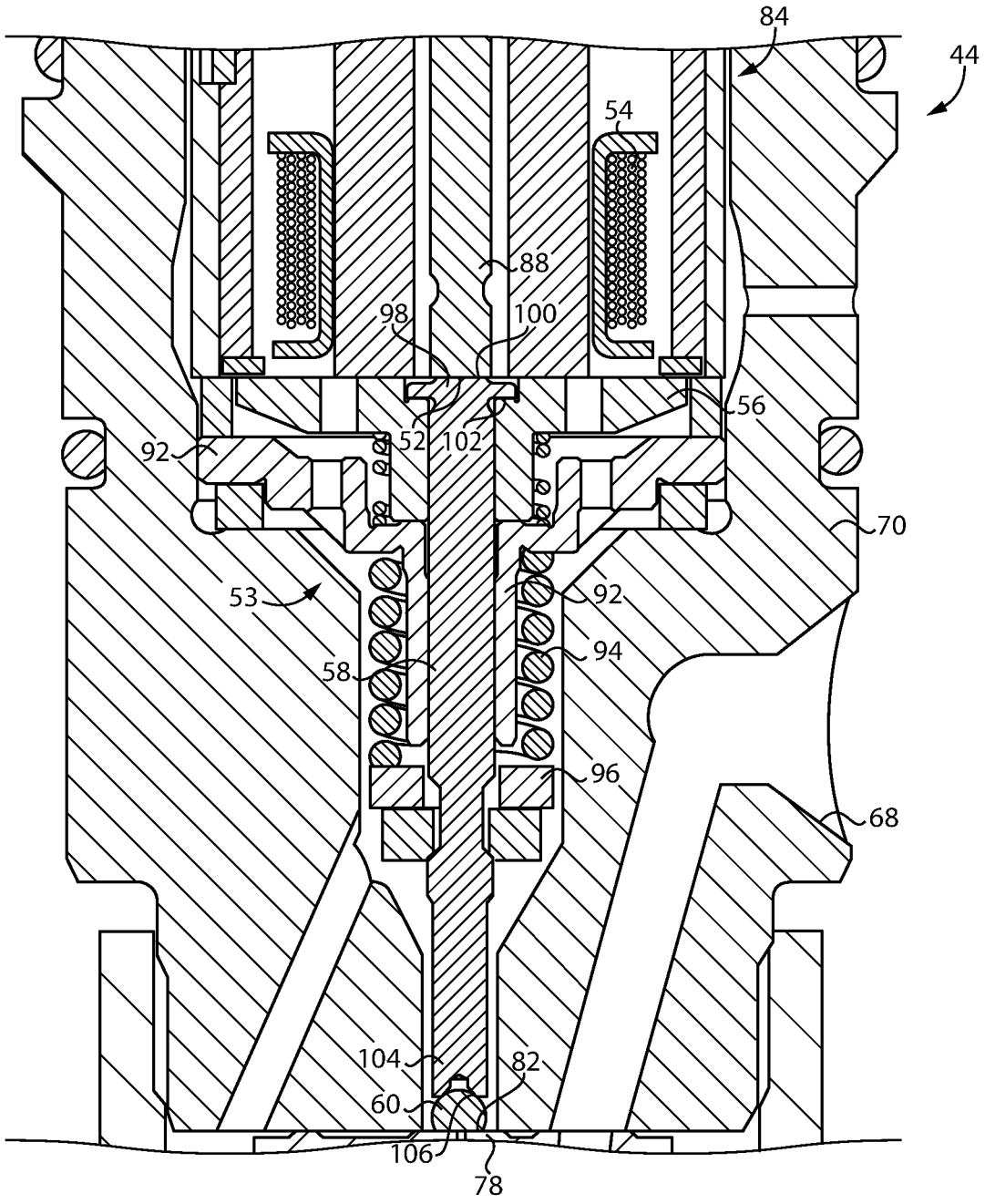
FIG. 3 is a sectioned side diagrammatic view of a portion of the fuel injector shown in FIG. 2.

Referring also now to FIG. 3, solenoid 54 is part of a solenoid subassembly 84 having a solenoid housing 86 and a centrally located stop piece 88 having stop 52 formed thereon. An electrical connector 90 is provided for electrically connecting fueling control unit 30 to solenoid 54. An armature housing 92 is positioned within injector body 70 and held at a fixed location, such that armature 56 and valve pin 58 move relative to armature housing 92 to lift valve pin 58 and drop valve pin 58 to control a position of injection control valve 60. A biasing spring 94 is held in compression between armature housing 92 and a collar 96 or the like upon valve pin 58 to bias valve pin 58 downward in the illustration of FIG. 3, and maintain injection control valve 60 normally closed except when solenoid 54 is energized.

Valve pin 58 includes a first pin end 98 having a first pin end surface 100 formed thereon and facing stop 52. Valve pin 58 also includes an armature contact surface 102 facing away from stop 52, and a second pin end 104 having a second pin end surface 106. From the illustrations it can be seen that injection control valve 60 includes a free-floating valve unattached to valve pin 58 and trapped between second pin end surface 106 and valve seat plate 78. Injection control valve 60 may be a ball valve, including a flat-sided ball valve as illustrated, and is movable, based on a position of valve pin 58, between a closed position blocking control chamber 50 from low pressure space 72, and an open position. Energizing solenoid 54 generates a magnetic field attracting armature 56, such that armature 56 is pulled toward solenoid subassembly 84, interacting with armature contact surface 102 to lift valve pin 58 and permit injection control valve 60 to open. Lifting of valve pin 58 will stop when first pin end surface 100 contacts stop 52. Armature 56 is stopped at the lifted position by contact between armature 56 and valve pin 58, namely, contact between valve pin 58 and armature contact surface 102. When solenoid 54 is deenergized the magnetic field decays and biasing spring 94 urges valve pin 58 and armature 56 down, closing injection control valve 60.

It has been observed that bouncing of a valve pin or other valve assembly structure against a stop can result in uncertainty, variability, or other errors in valve closing timing. In other words, the dynamic behavior of a valve pin, for example, when hitting a fixed stop can result in challenges in obtaining a precise and accurate injection control valve closing timing, in turn affecting a closing timing of a directly controlled outlet check, in the nature of outlet check 46. A ballistic operating region of valve pin 58 and armature 56 can be understood as that time period where armature 56 is in flight between a rest position and a lifted position. The present disclosure recognizes the potential for variability of the behavioral performance of these components in the ballistic region and provides operating and control strategies for limiting such variability. In particular, armature 56 can be retarded in lifting speed while in flight from a rest position toward a lifted position. This is achieved by way of providing multiple electrical current energizing pulses to solenoid 54. To this end, fueling control unit 30 may be structured to energize solenoid 54 with a lift current pulse to initially lift armature 56 from a down or rest position, and structured to energize solenoid 54 with a capture current pulse to subsequently capture armature 56 at an up or lifted position. Fueling control unit 30 is further structured to deenergize solenoid 54 a dwell time while armature 56 is in flight toward the lifted position. Fueling control unit 30 is still further structured to retard a lifting speed of armature 56 based on the deenergizing of solenoid 54 a dwell time so as to limit bouncing of valve pin 58 against stop 52. Retarding lifting speed can be understood as slowing armature 56, or limiting speed so as not to exceed a speed that is associated with bouncing or excessive bouncing. Whether armature speed is actually reduced in flight or merely limited may depend upon the components, materials, and control strategy, specifically implemented.

Figure 4:
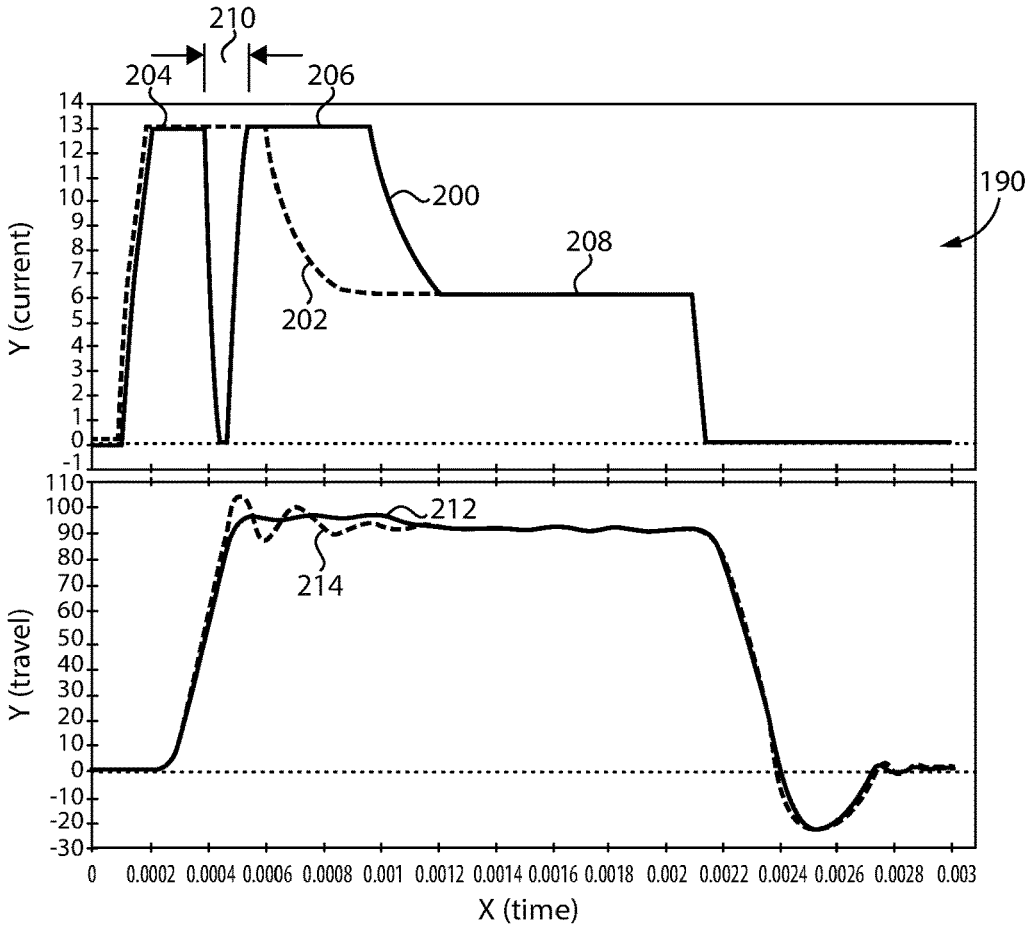
FIG. 4 is a graph showing fuel injector operating characteristics, for a fuel system operated according to the present disclosure in comparison with one conventional strategy.

Referring also now to FIG. 4, there is shown a graph 190 with time in seconds on the X-axis, and armature motion/travel in microns on a lower Y-axis, and solenoid energizing current in amperes on an upper Y-axis. In graph 190, a signal trace 202 represents electrical current that might be observed in a conventional operating strategy where a solenoid is energized with a conventional pull-in current of greater magnitude, transitioning to a conventional hold-in current of lesser magnitude. Another trace 200 illustrates electrical current as might be observed according to the present disclosure, including a lift current pulse 204 that is discrete from a capture current pulse 206. A dwell time 210 where solenoid 54 is fully deenergized or reduced in energy state, occurs between lift current pulse 204 and capture current pulse 206. Fueling control unit 30 is further structured to energize solenoid 54 with a hold current 208 having an amplitude less than an amplitude of capture current pulse 206 to hold armature 56 at the lifted position once captured. It can be noted a duration of dwell time 210 is less than a duration of lift current pulse 204. A duration of dwell time 210 may also be less than a duration of capture current pulse 206. Thus, a duration of dwell time 210 is less than at least one of a duration of lift current pulse 204 or capture current pulse 206 in at least some embodiments. Hold current 208 is not discrete from capture current pulse 206 in the illustrated embodiment, but instead transitions therewith. Deenergizing solenoid 54 a dwell time may include reducing an electrical current through solenoid 54 to an amplitude that is zero or negligible, as can be seen from FIG. 4.

As depicted in the lower portion of graph 190 there can be seen a first armature motion trace 212 according to the present disclosure in comparison to a second armature motion trace 214 that may be observed in a conventional strategy. Thus, armature motion trace 212 corresponds to electrical current trace 200 and armature motion trace 214 corresponds to electrical current trace 202. It can be seen that armature motion trace 214 exhibits variability greater than a variability of armature motion trace 212, consistent with expectations for valve pin and armature bouncing in the known strategy versus limited valve pin and armature bouncing according to the present disclosure.

Figure 5:
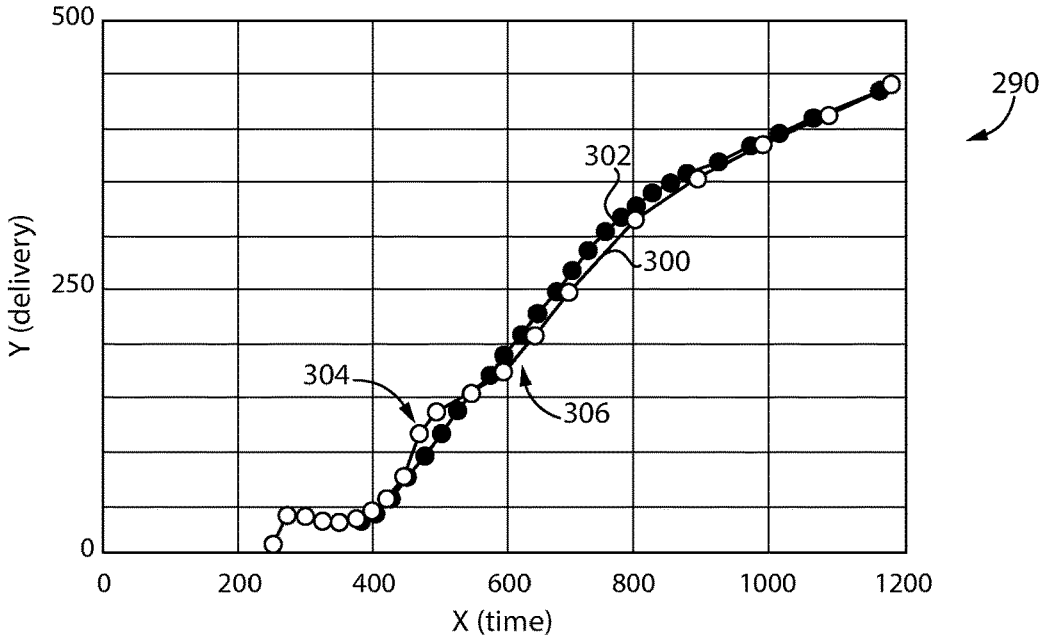
FIG. 5 is a graph showing fuel delivery curves for a fuel system operated according to the present disclosure in comparison with one conventional strategy.

Referring also now to FIG. 5, there is shown a graph 290 illustrating a delivery curve 300 for fuel delivery according to a conventional strategy in comparison to a delivery curve 302 for fuel delivery according to the present disclosure. In FIG. 5, time in microseconds of injector on-time, is shown on the X-axis and fuel delivery in cubic millimeters is shown on the Y-axis. It can be seen that fuel delivery curve 300 shows "knees" 304 and 306 representing non-linearity in fuel delivery as compared to relatively more linear fuel delivery curve 302.

INDUSTRIAL APPLICABILITY

Figure 6:
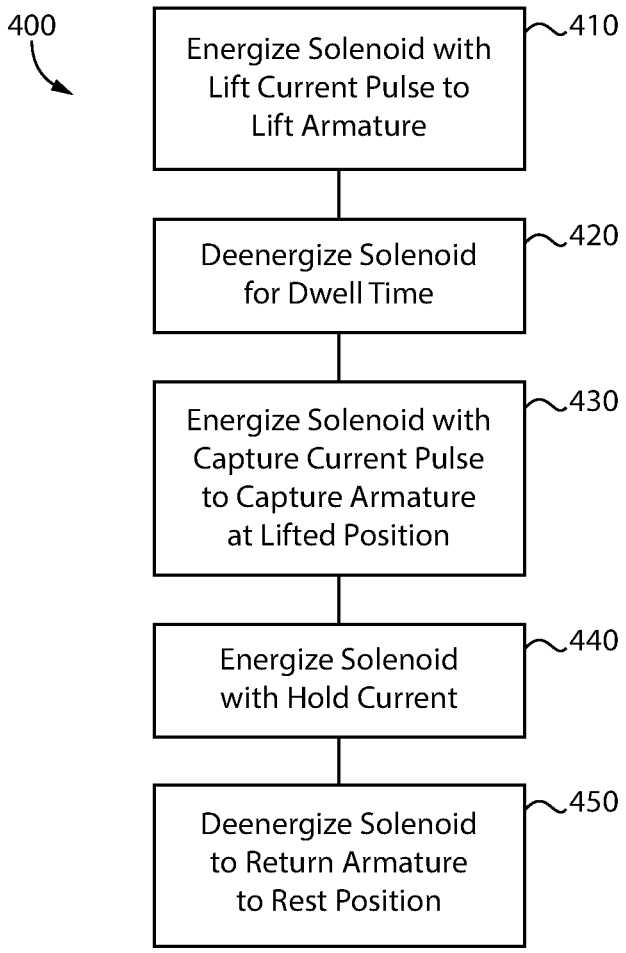
FIG. 6 is a flowchart illustrating example methodology and logic flow, according to one embodiment.

Referring to the drawings generally, but also now to FIG. 6 there is shown a flowchart 400 illustrating example methodology and logic flow according to one embodiment. In flowchart 400, at a block 410 solenoid 54 is energized with a lift current pulse to lift armature 56, coupled to injection control valve 60 in fuel injector 44, from a rest position. Energizing solenoid 54 as in block 410 can open injection control valve 60 based on the lifting of armature 56 to start an injection of fuel from fuel injector 44 using directly controlled outlet check 46.

From block 410, flowchart 400 advances to a block 420 to deenergize solenoid 54 for a dwell time as described herein. From block 420 flowchart 400 advances to a block 430 to energize solenoid 54 with a capture current pulse to capture armature 56 at the lifted position. Energizing solenoid 54 with the capture current pulse occurs after the lift current pulse. From block 430 flowchart 400 advances to a block 440 to energize solenoid 54 with a hold current as also described herein. From block 440 flowchart 400 advances to a block 450 to deenergize solenoid 54, returning armature 56 to the rest position under the influence of biasing spring 94 in the illustrated embodiment. Injection control valve 60 is thereby closed based on returning armature 56 to the rest position to end an injection of fuel using directly controlled outlet check 46.

It will be recalled that fueling control unit 30 stores trim table 38 upon computer readable memory 34. It is contemplated that the presently disclosed multi-pulse solenoid energizing strategy may be used in electronically trimming fuel injectors during certain operating conditions, and used differently or not at all for electronically trimming fuel injectors in other operating conditions. It will also be recalled fuel control system 28 includes engine state sensor 42. At certain engine states fuel delivery may be relatively large, for example, in an upper half or other portion of an engine speed range or engine load range. In such instances, valve pin bouncing might be less of a concern, for example because the relatively large fuel delivery amounts are less impacted by small variations in delivery amount that can result from valve closing timing aberrations. At lower engine speeds or lower engine loads, the relatively small fuel delivery amounts can be relatively more proportionately impacted by such aberrations. Accordingly, trim table 38 may store trim files read by data processor 32, and used to electronically trim fuel injectors 44. Electronically trimming fuel injectors 44 can be performed by energizing solenoid 54 to produce the separate lift current pulse, capture current pulse delayed relative to the lift current pulse, and dwell time, based on a stored trim file.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel system for an engine comprising:

a fuel injector including an outlet check having a closing hydraulic surface exposed to a fluid pressure of a control chamber formed in the fuel injector, a stop, and an injection control valve assembly including a solenoid, an armature, and a valve pin coupled to the armature; and a fueling control unit electrically connected to the solenoid and structured to:

energize the solenoid with a lift current pulse to lift the armature;

energize the solenoid with a capture current pulse to capture the armature at a lifted position;

deenergize the solenoid a dwell time, prior to the energizing the solenoid with the capture current pulse, while the armature is in flight based on the energizing the solenoid with the lift current pulse toward the lifted position; and retard the armature based on the deenergizing of the solenoid a dwell time to limit bouncing of the valve pin against the stop.

2. The fuel system of claim 1 wherein the fueling control unit is further structured to energize the solenoid with a hold current having an amplitude less than an amplitude of the capture current pulse to hold the armature at the lifted position once captured.

3. The fuel system of claim 2 wherein a duration of the dwell time is less than a duration of the lift current pulse and less than a duration of the capture current pulse.

4. The fuel system of claim 2 wherein the deenergizing of the solenoid a dwell time further includes reducing an electrical current through the solenoid to an amplitude that is zero or negligible.

5. The fuel system of claim 1 wherein the fueling control unit is further structured to read a stored trim file, and to perform the deenergizing of the solenoid based on the stored trim file.

6. The fuel system of claim 1 wherein the fuel injector further includes a solenoid subassembly having a centrally located stop piece forming the stop, and the armature is stopped at the lifted position by contact between the armature and the valve pin.

7. The fuel system of claim 6 wherein the fuel injector further includes an injection control valve movable, based on a position of the valve pin, between a closed position blocking the control chamber from a low pressure space, and an open position.

8. The fuel system of claim 7 wherein:

the valve pin includes a first pin end having a first pin end surface facing the stop, an armature contact surface facing away from the stop, and a second pin end having a second pin end surface; and the fuel injector further includes a valve seat plate, and the injection control valve is free-floating and trapped between the second pin end surface and the valve seat plate.

9. A method of operating a fuel system for an internal combustion engine comprising:

energizing a solenoid with a lift current pulse to lift an armature coupled to an injection control valve in a fuel injector from a rest position to a lifted position;

opening the injection control valve based on the lifting of the armature to start an injection of fuel from the fuel injector using a directly controlled outlet check;

energizing the solenoid with a capture current pulse occurring a dwell time after the lift current pulse to capture the armature at the lifted position;

returning the armature to the rest position; and closing the injection control valve based on the returning of the armature to the rest position to end an injection of fuel using the directly controlled outlet check.

10. The method of claim 9 further comprising electronically trimming the fuel injector based on the energizing of the solenoid with a lift current and the energizing of the solenoid with a capture current.

11. The method of claim 9 further comprising energizing the solenoid with a hold current to hold the armature at the lifted position once captured.

12. The method of claim 11 wherein the hold current has an amplitude less than an amplitude of the capture current pulse.

13. The method of claim 12 wherein the lift current pulse is discrete from the capture current pulse, and the hold current is not discrete from the capture current pulse.

14. The method of claim 9 further comprising retarding the armature, and limiting bouncing a valve pin coupled to the injection control valve against a stop based on the retarding of the armature.

15. The method of claim 14 further comprising lifting the valve pin based on the lifting of the armature, and wherein the opening of the injection control valve includes opening a free-floating injection control valve trapped between the valve pin and a valve seat.

16. The method of claim 9 wherein a duration of a dwell time between the lift current pulse and the capture current pulse is less than at least one of a duration of the lift current pulse or a duration of the capture current pulse.

17. A fuel control system comprising:

a fueling control unit including a data processor, and a computer readable memory;

the computer readable memory storing fueling control instructions for actuating a fuel injector to inject fuel into a combustion cylinder in an engine;

the data processor is structured by way of executing the fueling control instructions to:

energize a solenoid in the fuel injector with a lift current pulse to lift an armature coupled to a valve pin in an injection control valve assembly;

energize the solenoid with a capture current pulse to capture the armature at a lifted position;

deenergize the solenoid for a dwell time, prior to the energizing the solenoid with the capture current pulse, while the armature is in flight based on the energizing the solenoid with the lift current pulse from the rest position toward the lifted position; and retard a lifting speed of the armature based on the deenergizing of the solenoid for a dwell time so as to limit bouncing the valve pin against a stop in the fuel injector.

18. The fuel control system of claim 17 wherein the data processor is further structured to energize the solenoid with a hold current having an amplitude less than an amplitude of the capture current pulse to hold the armature at the lifted position once captured.

19. The fuel control system of claim 18 wherein the lift current pulse is discrete from the capture current pulse, and the hold current is not discrete from the capture current pulse.

20. The fuel control system of claim 19 wherein a duration of the dwell time is less than at least one of a duration of the lift current pulse or a duration of the capture current pulse.

* * * * *